US006912966B2

(12) United States Patent
Ostreng et al.

(10) Patent No.: US 6,912,966 B2
(45) Date of Patent: Jul. 5, 2005

(54) MOLDED PLASTIC GANGWAY

(75) Inventors: Troy Ostreng, Nixa, MO (US); Larry Moody, Monett, MO (US)

(73) Assignee: E-Z Dock, Inc., Monett, MO (US)

( * ) Notice: Subject to any disclaimer, the term of this patent is extended or adjusted under 35 U.S.C. 154(b) by 0 days.

(21) Appl. No.: 10/665,968

(22) Filed: Sep. 18, 2003

(65) Prior Publication Data

US 2005/0061227 A1 Mar. 24, 2005

(51) Int. Cl.[7] ..... B63B 35/44
(52) U.S. Cl. ..... 114/263; 114/367
(58) Field of Search ..... 114/263, 362; 14/71.1

(56) References Cited

U.S. PATENT DOCUMENTS

| | | | | |
|---|---|---|---|---|
| 2,792,164 | A | | 5/1957 | Cauffiel |
| 2,879,735 | A | | 3/1959 | Pointer |
| 3,009,326 | A | | 11/1961 | Williams |
| 3,035,286 | A | | 5/1962 | Brill |
| 3,073,271 | A | | 1/1963 | Brill |
| 3,110,046 | A | | 11/1963 | Fischer |
| 3,276,209 | A | | 10/1966 | Mosdell |
| 3,561,375 | A | | 2/1971 | Hammond et al. |
| 3,654,885 | A | | 4/1972 | Godbersen |
| 3,752,102 | A | | 8/1973 | Shuman |
| 3,780,686 | A | | 12/1973 | Brill |
| 3,824,644 | A | | 7/1974 | Stranzinger |
| 3,897,741 | A | | 8/1975 | Martini |
| 3,907,505 | A | | 9/1975 | Beall et al. |
| 3,909,996 | A | | 10/1975 | Ettlinger, Jr. et al. |
| 4,041,716 | A | | 8/1977 | Thompson |
| 4,604,962 | A | | 8/1986 | Guibault |
| 4,660,495 | A | | 4/1987 | Thompson |
| 4,799,445 | A | * | 1/1989 | Meriwether ..... 114/267 |
| 4,928,617 | A | | 5/1990 | Meriwether |
| 4,974,538 | A | | 12/1990 | Meriwether |
| 5,048,448 | A | | 9/1991 | Yoder |
| 5,125,355 | A | | 6/1992 | Stranzinger |
| 5,247,899 | A | * | 9/1993 | Boesser ..... 114/263 |
| 5,281,055 | A | | 1/1994 | Neitzke et al. |
| 6,073,572 | A | | 6/2000 | Gruhn et al. |
| 6,179,525 | B1 | * | 1/2001 | Gruhn et al. ..... 405/219 |

FOREIGN PATENT DOCUMENTS

| | | |
|---|---|---|
| GB | 1058586 | 2/1967 |

OTHER PUBLICATIONS

EZ Dock, Inc.,—EZ Dock pamphlet—"Self–floating Dock and Lift Systems"—pp. 2–11.

* cited by examiner

*Primary Examiner*—Ed Swinehart
(74) *Attorney, Agent, or Firm*—Polster, Lieder, Woodruff & Lucchesi LC

(57) ABSTRACT

A molded gangway section is provided to form a gangway between a shore and a dock, pier, and the like. The gangway includes an upper tread surface and a bottom surface having recesses formed therein. The ceilings or upper surfaces of the recesses are formed with grooves. Two or more of the gangway sections can be connected together to form gangways of incrementally increasing lengths. Hinge connections are provided to connect the gangway to piers, docks, shore abutments, ramps, etc. Additionally, a roller can be mounted to a shore end of the gangway.

25 Claims, 10 Drawing Sheets

MOLDED PLASTIC GANGWAY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to gangways used for example with docks, piers, and the like, and in particular, to a gangway which is molded from plastic.

Gangways have long been used to provide access between shore and docks, or between docks and boats. Gangways that are currently used are often one piece units that are assembled on-site. These gangways are time consuming and difficult to assemble. Additionally, the gangways are difficult to secure, for example, to the dock, a shore abutment, etc. Further, once assembled, the gangways are difficult to remove, for example, for storage in winter or for repair.

BRIEF SUMMARY OF THE INVENTION

Briefly stated, a molded gangway section of the present invention comprises an upper surface, side surfaces, and a lower surface, which, in combination define a volume. Preferably, the volume is hollow (i.e., empty), but could be filled, for example, with foam or other buoyant materials. The gangway sides extend above the top surface and define rails. The top surface includes spaced apart, generally parallel grooves, which extend across the top surface from one side to the other. Additionally, a groove extends along the junction between the upper surface and at least one of the side walls.

The lower surface comprises a plurality of recesses which are defined by a side wall extending from the lower surface towards the upper surface and a recess ceiling. A plurality of grooves, which extend generally parallel to the upper surface grooves, are formed in the recess ceiling. Preferably, the recesses are formed in at least three columns—there being two side columns and one center column. There can also be two or more center columns. Preferably, the columns are made of rows of recesses, such that the recesses define an array or recesses, such as a 3×3 or 4×3 array of recesses.

A trough is formed in the lower surface between the outer and center columns of recesses. Additional surface grooves are formed in the bottom surface between the rows of recesses. A surface groove is also formed in the gangway bottom surface between the outer columns of recesses and the sides of the gangway. The lower surface also includes a connecting surface at opposite ends of the gangway. Preferably, the connecting surface is divided into three areas which are aligned with the columns of recesses.

The recess ceiling grooves are adjacent, and preferably, in contact with, the lower side of the upper surface. The recess ceiling grooves preferably include two types of grooves—the first grooves are positioned to be under the upper surface grooves and the second grooves are positioned between the upper surface grooves. The first grooves are formed by a wall of substantially constant width. The second grooves, of at least the outer column of recesses, have a first portion of a first thickness and a second portion of a second thickness, thicker than the first portion.

Two or more gangway sections can be connected together to form a gangway. Gangway sections can be connected using a reinforcing member or truss which is received in the gangway bottom surface trough. The truss is sized to extend across the junction between adjacent gangway sections. The truss is secured to the gangway sections by fasteners which extend through the gangway section upper surface and into the truss. The gangway sections can also be connected by use of connector plates which span the junction between two adjacent gangways. The connecting plates, which are sized to span the junction between adjacent gangway sections, are secured to the connecting surface on the gangway section bottom surface. Preferably, two connecting plates are used—one on each of the outer connecting surface areas. The gangway sections can be connected using either of the two methods independently, but, are preferably connected together using the trusses and the connecting plates in combination.

The gangway connecting surface is also used to connect the gangway to shore abutments, piers, docks, etc. The gangway section includes a hinge member mountable to the connection surface. Preferably, hinge members are mounted in all three areas of the connection surface. The hinge members includes pin sleeves which, when the hinge member is mounted to the gangway section, extend outwardly from the end of the gangway section.

The gangway section can be mounted to a shore abutment or dock using a bracket. The bracket includes pin sleeves positioned to be aligned with the pin sleeves of the hinge member. A hinge pin extends through the pin sleeves of the hinge member and the bracket to hingedly connect the gangway to the shore abutment bracket, and hence, the shore abutment.

The gangway section can also be provided with a roller assembly and/or a ramp. The ramp includes a sloped upper surface, a back surface, and ears extending from the back surface. The ears include openings therein which are aligned with the hinge member pin sleeves when the ramp is adjacent the gangway section. A hinge pin which extends through the hinge member pin sleeve and the ramp ears to hingedly connect the ramp to the gangway. The roller assembly includes opposed mounting members mountable to lower surfaces of the sides of the gangway and a roller extending between the mounting members. The roller is vertically spaced from the connecting surface and the mounting brackets are horizontally spaced from the connecting surface. Thus, the roller assembly can be mounted to the gangway along with the ramp.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
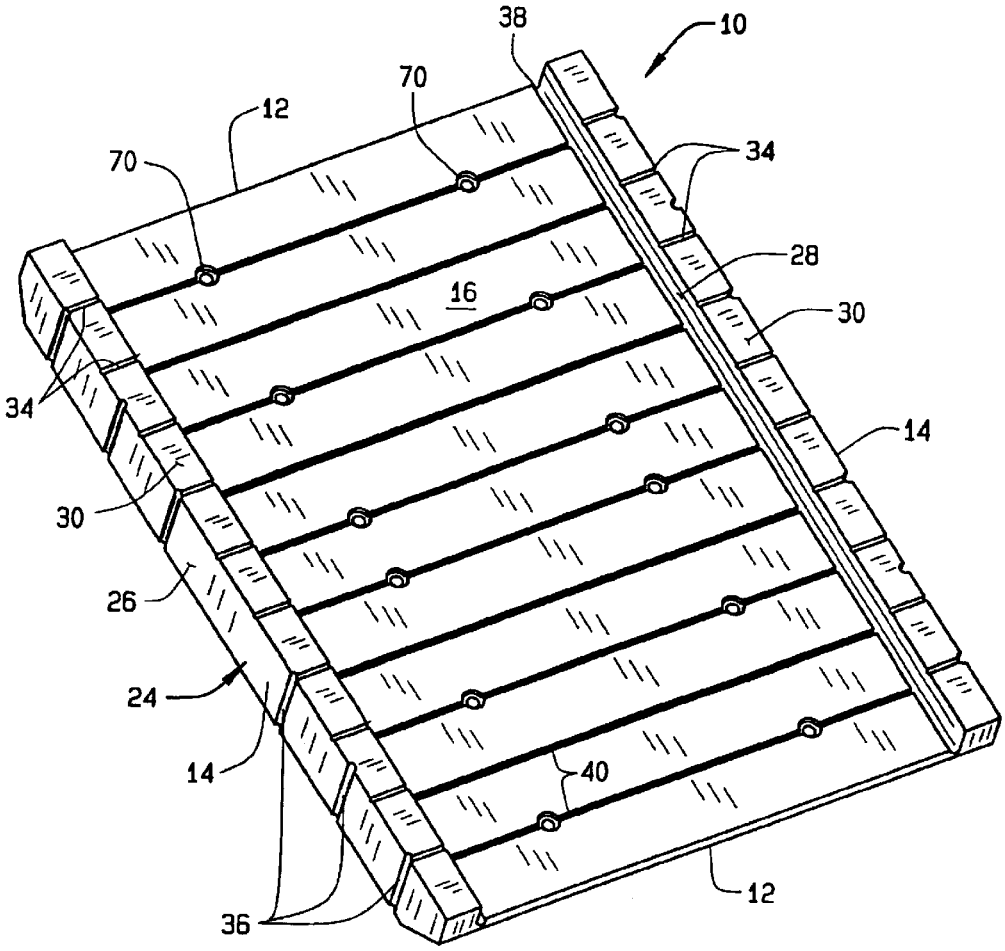
FIG. 1 is a top perspective view of a gangway section of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 2:
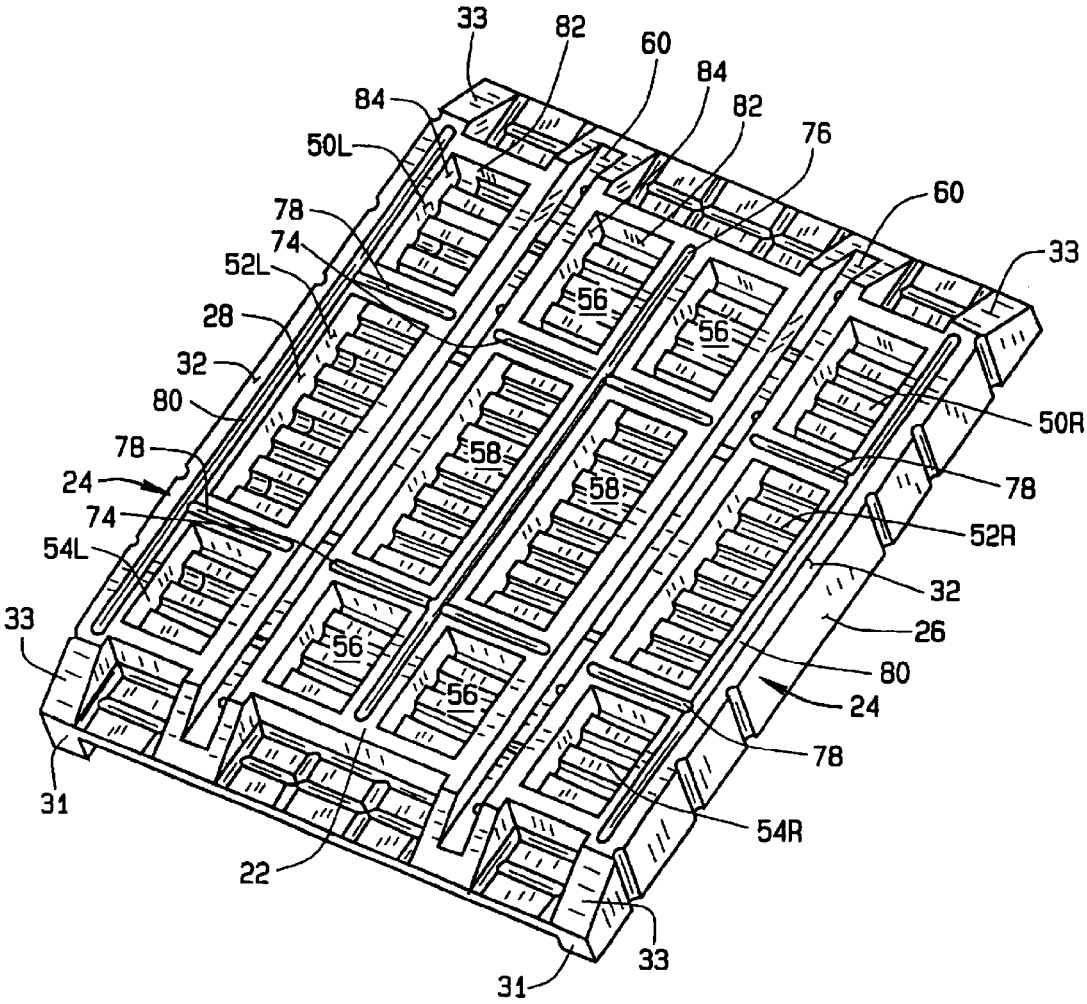
FIG. 2 is a bottom perspective view of the gangway section.

An illustrative embodiment of a gangway section 10 of the present invention is seen generally in FIGS. 1 and 2. A complete gangway can be formed from a single gangway section 10, or two or more of the gangway sections 10 can be connected together, as will be described below, to form a gangway of a desired length.

The gangway section 10 is quadrilateral in shape having two opposed and generally parallel ends 12 and two opposed and generally parallel sides 14. In a preferred embodiment, the gangway section is about 6' long and about 4' wide. These dimension, of course, can be changed if desired.

Figure 5:
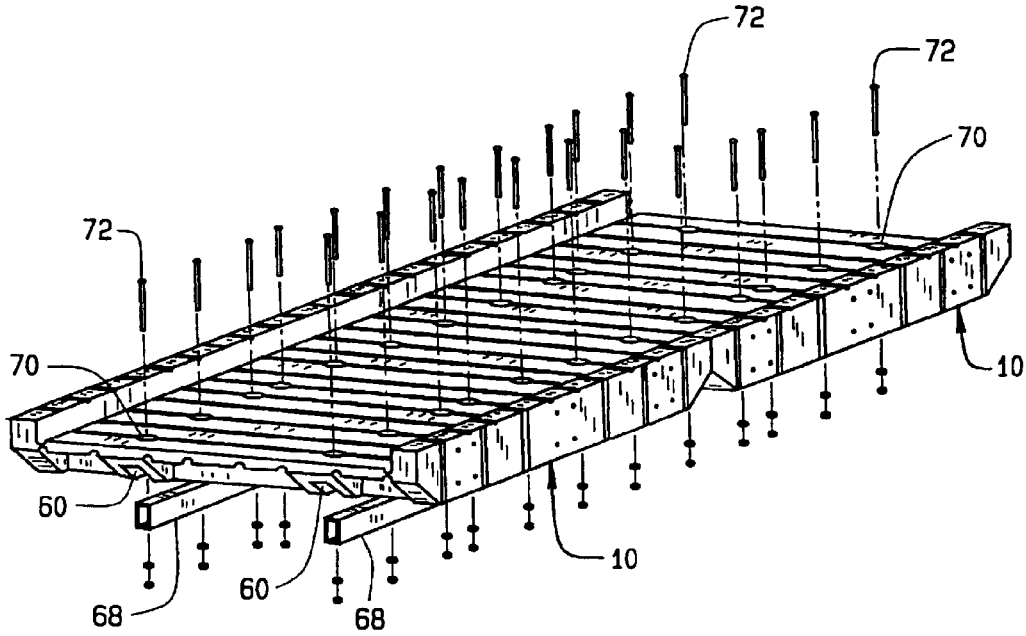
FIG. 5 is a top perspective view showing the connection of trusses to the two sections.
Figure 6:
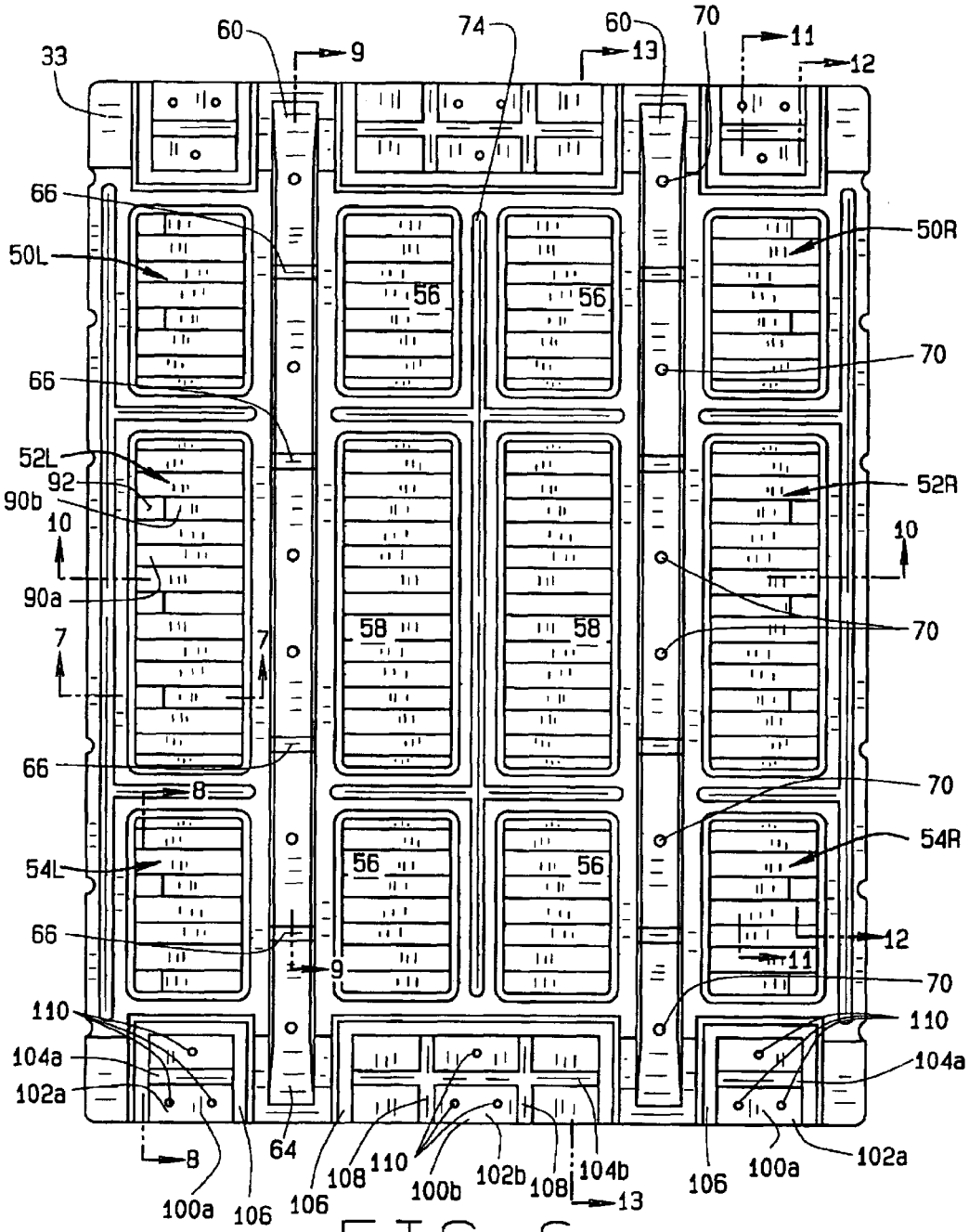
FIG. 6 is a bottom plan view of the gangway section.
Figure 7:
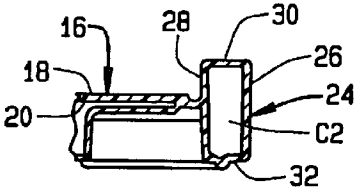
FIG. 7 is a cross-sectional view of the gangway taken along line 7—7 of FIG. 6.
Figure 8:
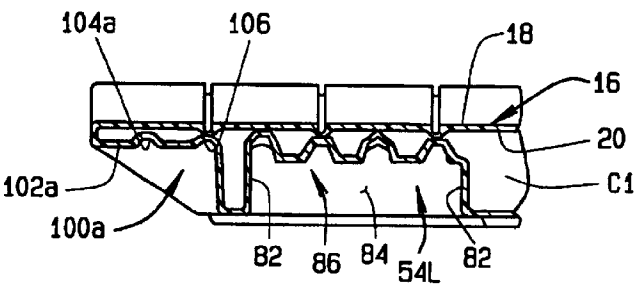
FIG. 8 is a cross-sectional view of the gangway taken along line 8—8 of FIG. 6.
Figure 9:
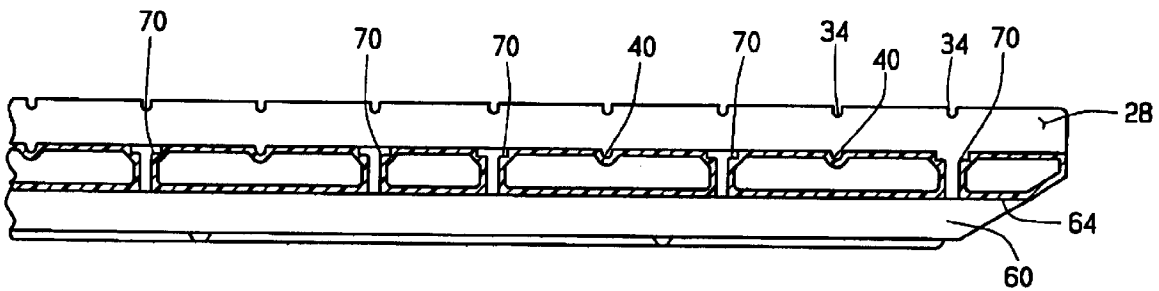
FIG. 9 is a cross-sectional view of the gangway taken along line 9—9 of FIG. 6.

The gangway section 10 includes an upper surface 16 having a top side 18 upon which a person walks and a bottom side 20; a bottom surface 22 spaced from the upper surface; and opposed sides 24 extending between the upper surface 16 and the bottom surface 22. The sides 24 are generally rectangular in cross-section, as seen best in FIGS. 7 and 10. The sides 24 include an outer wall 26, an inner wall 28, a top wall 30 and a bottom wall 32. The side bottom wall 32 is approximately level with the gangway section bottom surface 22. The side top wall 30, however, is spaced above the gangway section upper surface 16. Thus, the sides 24 define rails which extend the length of the gangway section. As seen in FIGS. 2 and 5, the sides 24 are generally pentagonal in side elevation. They include generally flat and parallel top and bottom surfaces defined by the top and bottom walls 30 and 32, end surfaces 31 at opposite ends of the side walls, and sloped surfaces 33 extending between the bottoms of the end surfaces 31 and the opposed ends of the bottom walls 32 (which are not as long as the top walls 30). As best seen in FIG. 1, the sides 24 include grooves 34 on the side top wall 30 which extend between the outer and inner walls 26 and 28, respectively, and grooves 36 on the outer side walls 26 which extend between the side top and bottom walls 30 and 32, respectively. As seen in FIG. 1, the sides 24 can be divided into end sections which have the side wall grooves 36 and a central section which does not have the grooves 36. In the end sections, with the grooves 36, there are side wall grooves 36 which intersect with the top wall grooves 34 and side wall grooves 36 between the position of the top wall grooves 34.

Returning to the gangway upper surface, the upper surface is provided with channels 38 at the junction of the side inner wall 28 and the gangway upper surface 16. Transverse channels 40 extend across the width of the gangway upper surface 16 between the channels 38, and intersect with the channels 38. Preferably, the channels 40 are co-linear with the side top wall channels 34. The channels 38 are deeper than the channels 40. Hence, the channels 40 empty into the channels 38. As can be appreciated, the channels 40 define a waterway to direct water off the upper surface of the gangway. The channels 40 facilitate movement of any water on the gangway upper surface to the channels 38.

Turning now to the bottom of the gangway section 10, the bottom surface is provided with a plurality of recesses 50L, 50R, 52L, 52R, 54L, 54R, 56 and 58. The recesses 50L and 50R are mirror images of each other, as are recesses 52L and 52R and recesses 54L and 54R. The recesses 50L, 50R, 52L, 52R, 54L, and 54R are side recesses and are substantially similar to each other, hence, only one of the recesses will be described below. The recesses 56 and 58 are inner recesses and differ from the side recesses in only one respect, which will be pointed out below. As can be seen in FIG. 2, the recesses are all generally quadrilateral in plan and are arranged in 3×4 array. The end recesses 50L,R, 54L,R, and 56 are shorter than the center recesses 52R,L and 58. The side recesses are separated from the inner recesses by troughs 60 defined by trough side walls 62 and a trough upper wall 64 which is spaced from the bottom side 20 of the gangway upper surface 16. A plurality of spaced apart grooves 66 extend across the troughs 60. The troughs 60 are sized and shaped to receive trusses 68 (FIG. 3) to connect to gangway sections 10 together, as will be described below. A plurality of screw holes 70 extend through the gangway upper surface 16 and into the channel 60 to accept fasteners 72 (such as bolts or screws) to secure the trusses 68 in the channels 60.

Grooves 74 are formed in the gangway bottom surface 22 between the inner end recesses 56 and the inner central recesses by grooves 74. Additionally, a groove 76 is formed in the bottom surface 22 between the two rows of inner recesses. Similarly, grooves 78 are formed in the gangway bottom surface 22 between the side end recesses 50R,L and 54R,L. Lastly, an elongate groove 80 extends alongside of the side recesses in the gangway bottom surface 16 (which at that point also forms the bottom wall 32 of the sides 24).

Figure 10:
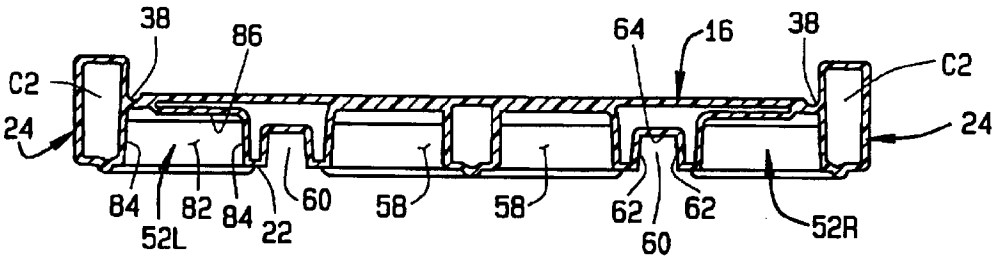
FIG. 10 is a cross-sectional view of the gangway taken along line 10—10 of FIG. 6.
Figure 11:
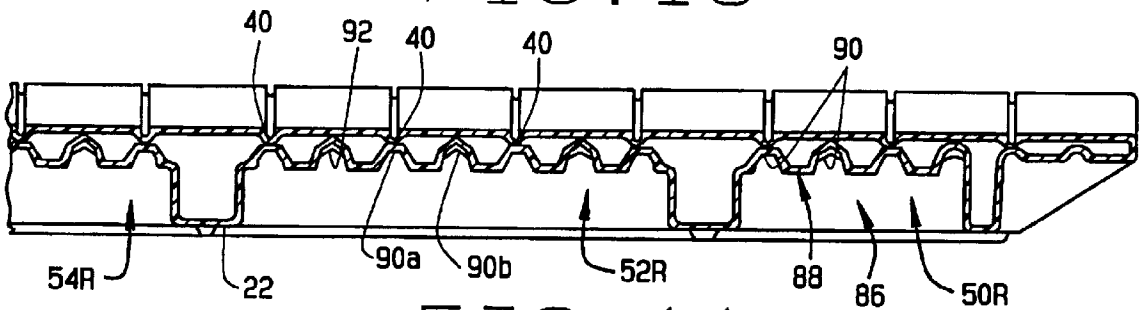
FIG. 11 is a cross-sectional view of the gangway taken along line 11—11 of FIG. 6.

Turning to FIGS. 7–13, the recesses are all generally similar in configuration. The recesses include end walls 82 which are generally parallel to the ends 12 of the gangway section 10, side walls 84 which are generally parallel to the sides 24 of the gangway, and ceilings 86 which span between the opposed end walls 82 and opposed side walls 84. For the side recesses 50R,L, 52R,L, and 54R,L, the outer side wall of the recesses is also the inner side wall 28 of the gangway side 24. As can be seen, the recesses all have a generally quadrilateral shape. However, the shape of the recesses could be changed, and the recesses could be circular, triangular, trapezoidal, or any other desired shape in plan view. The recess ceiling 86 includes a ceiling surface 88 with a series of spaced apart, generally perpendicular grooves 90 extending between the recess sidewalls 84. The grooves 90 give the recess ceiling 86 a generally crenellated appearance in cross-section, as seen in FIGS. 8 and 11–13. The ceiling surface 88 is spaced from the bottom side 20 of the gangway upper surface 18, and the grooves 90 have a peak which is adjacent the bottom side 20 of the gangway upper surface 18. Preferably, the groove peaks contact, or are spaced only slightly from, the gangway upper surface bottom side 20. Actually, there are two sets or types of grooves 90. Grooves 90*a* are beneath the gangway upper surface grooves 40 and grooves 90*b* are spaced between the gangway upper surface grooves 40. The contact between the grooves 90*b* and the bottom 20 of the upper surface is shown in FIG. 10, where, the top of the groove 90*a* is essentially merged into the bottom of the gangway upper section. The bottom (or exposed) surface of the grooves 90*a* and 90*b* are substantially identical. However, the inner or upper surface of the walls which form the grooves 90*a* and 90*b* are varied slightly. While these inner surfaces are both generally trapezoidal in shape, the grooves 90*a* generally come to a point at their peaks where they are closest to the gangway upper surface. The grooves 90*b*, on the other hand, have a generally flat peak area where the grooves 90*b* are closest to the upper surface grooves 40. As can be appreciated, because the grooves 90*a* extend upwardly to contact (or nearly contact) the bottom of the gangway upper surface and the grooves 90*b* extend upwardly to contact (or nearly contact) the bottom of the upper surface grooves 40, the grooves 90*a* are deeper than the grooves 90*b*. The grooves 90*a* and 90*b* are formed by a groove wall that has a generally constant thickness.

Figure 12:
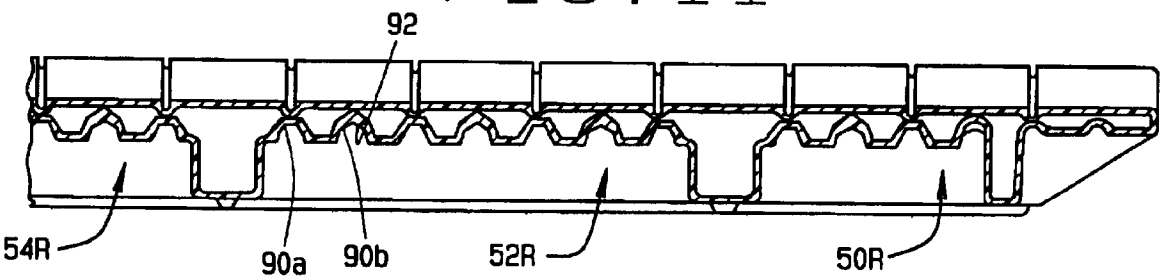
FIG. 12 is a cross-sectional view of the gangway taken along line 12—12 of FIG. 6.
Figure 13:
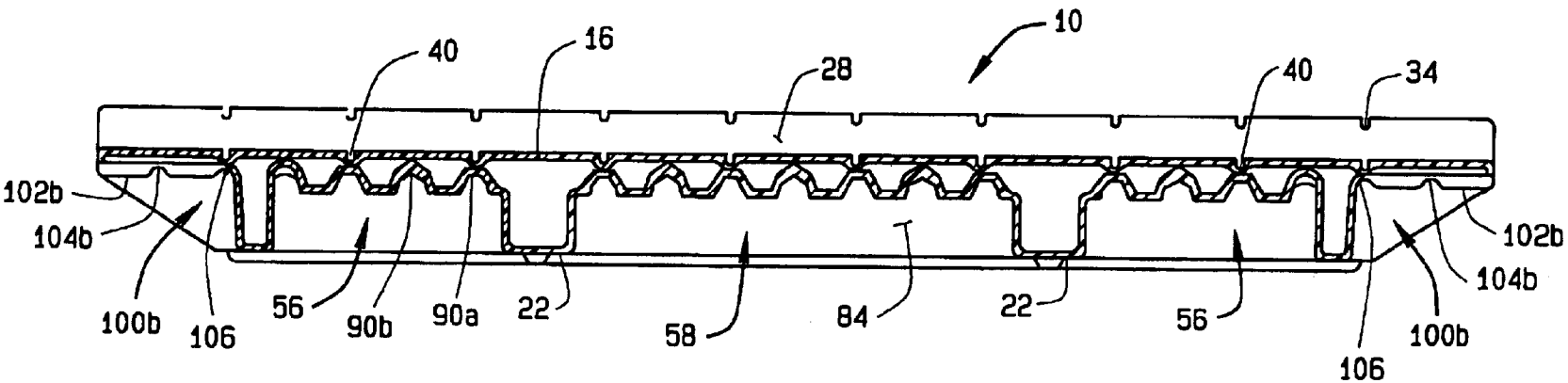
FIG. 13 is a cross-sectional view of the gangway taken along line 13—13 of FIG. 6.

In the side recesses 50R,L, 52R,L, and 54R,L, the grooves 90*a*, are formed in two parts or portions. The grooves 90*a* include an inner portion having a wall thickness substantially similar to the wall thickness of the groove 90*b*. The grooves 90*a* also include an outer portion which, as seen in FIG. 12, has an increased wall thickness, especially along the top of the groove. This second outer portion of the groove 90*a* extends from the recess outer side wall 84 a distance equal to about ¼ to about ⅓ the length of the groove. In the second portion, where the grooves 90*a* are thickened, the grooves are less deep. Preferably, the depth of the grooves 90*a* in the second portion is about as deep as the grooves 90*b*. Stated differently, the groove 90*a* is thickened in the second portion such that its depth in this second portion is approximately equal to the depth of the grooves 90*b*. The grooves 90*a* of the inner recesses 56 and 58 do not include any such thickened area.

The recesses, in combination, do not extend the full length of the gangway section 10. The gangway section 10 is provided with attachment areas 100*a,b* at opposite ends of the gangway section in the bottom surface 22 of the gangway section 10. The gangway sections 100*a,b* are all recessed relative to the gangway bottom surface 22 and have connection surfaces 102*a,b* which are substantially parallel with the cavity ceiling surfaces 88. The attachment areas 100*a* are co-linear with the side recesses 50R,L, 52R,L and 54R,L and have a width substantially equal to the width of the side recesses. The attachment areas 100*b* are at the ends of the inner recesses 56 and 58 and have a width substantially equal to the combined width of the two rows of inner recesses. The attachment areas 100*a,b* each include a groove 104*a,b* which extends generally perpendicular to the gangway sides 24 across the approximate center of the attachment surfaces 102*a,b*. A circumferential groove 106 extends around three sides of the attachment surfaces 102*a,b*, such that the grooves 106 have a generally U-shaped appearance in plan view. Additionally, the attachment surfaces 102*b* each include grooves 108 which extend generally perpendicularly to the grooves 104*b* and effectively divide the attachment surfaces 102*b* into thirds. Each third of the attachment surface 102*b* is approximately equal in width to the attachment surfaces 102*a*. Lastly, the attachment surfaces 102*a,b* are provided with screw holes 110. Preferably, each attachment surface is provided with three screw holes 110 formed in a generally triangular pattern. Two screw holes are provided between the end of the gangway section and the groove 104*a,b* and one hole is provided between the groove 104*a,b* and the U-shaped groove 106.

The surfaces which define the gangway section, as described above, in combination, define a chamber C1. Additionally, the surfaces which define the sides 24 define a second chamber C2 which, preferably, is separate and distinct from the chamber C1. The chambers C1 and C2 are preferably hollow. Hence, the gangway section is buoyant. One or all of the chambers could be filled with a buoyant material, such as foam, to increase buoyancy of the gangway section, if necessary.

As mentioned above, two or more gangway sections 10 can be connected together to form a longer gangway. To connect the two gangway sections together, a connection plate 120 is provided for the outer attachment areas 100*a*.

Figure 3:
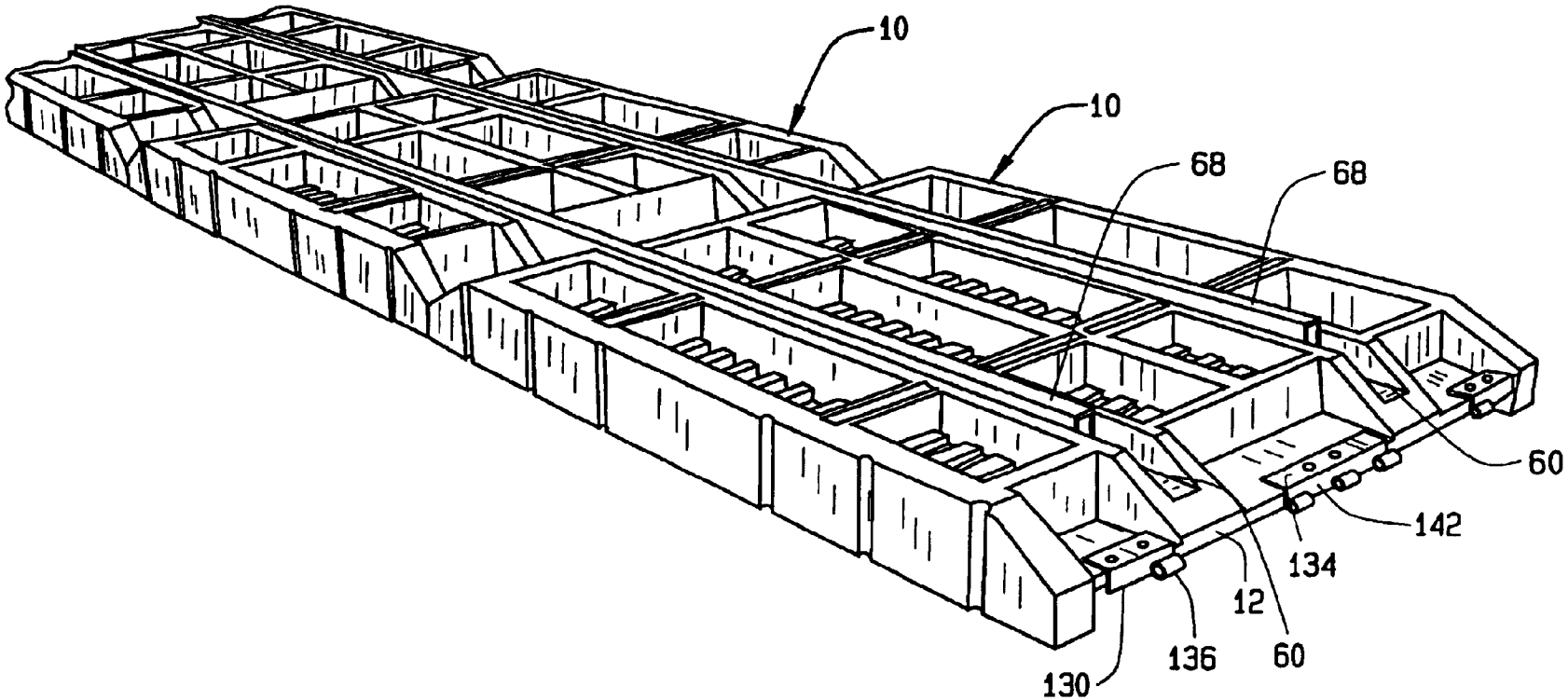
FIG. 3 is a bottom perspective view of two gangway sections connected together.
Figure 4:
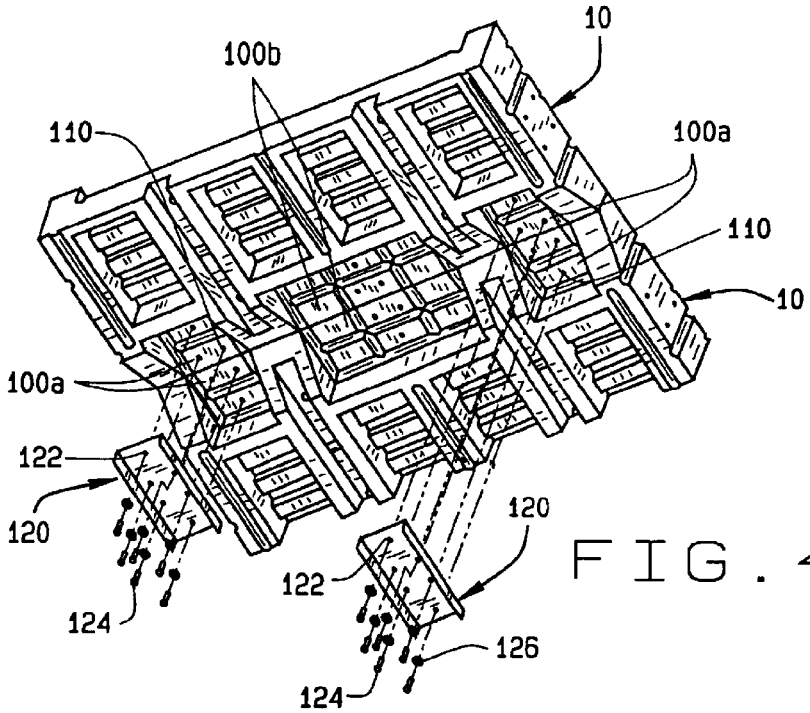
FIG. 4 is a bottom exploded perspective view showing connection plates used to connect the two sections together.

The plates 120 have a length approximately equal to the combined length of the attachment surfaces 102*a* when two gangway sections are in abutting relationship, as seen in FIG. 3. Hence, the plates 120 will span across the two gangway sections 10. The plates 120 are provided with screw holes 122 which are arranged in a pattern such that the screw holes 122 will be aligned with the screw holes 110 of the attachment surfaces 102*a*. Screws 124 (preferably with washers 126) are passed through the connection plate screw holes 122 and into the attachment surface screw holes 110 in order to connect two gangway sections together. The connection plates are made from a material, such as aluminum, which will not rust upon prolonged exposure to water. The plates could also be made of other materials. As can be appreciated, because the connection plates 120 are relatively short, trusses 68 (FIGS. 3 and 5) are provided. The trusses 68 are received in the bottom surface troughs 60. Fasteners 72 are passed through the holes 70 in the gangway upper surface and through the trusses 68 to secure the trusses 68 to the gangway section. Preferably, the fasteners are bolts, which are passed through the gangway section and trusses and receive nuts to hold the trusses to the gangway section. The trusses can be provided with bolt holes, or bolt holes can be drilled through the trusses on site. Preferably, two trusses are provided, which, as described above, are positioned between the three rows of recesses. However, the gangway bottom section could be modified to use a single truss extending, for example, along the center of the gangway section.

The trusses 68 are provided to increase stability of the gangway. Hence, trusses 68 extend the full length of the gangway. Thus, if the gangway comprise three sections, the trusses will extend for three sections (or 18' for three 6' long sections). If the gangway comprises only two section, then the trusses will have an overall length of 12'. The trusses can each be comprised of a single long truss, or can be made of truss sections which are secured to the gangway sections. If truss sections are used, the junctions between adjacent truss sections is positioned away from the junction between adjacent gangway sections, and is preferably positioned near the center of the gangway sections.

Figure 14:
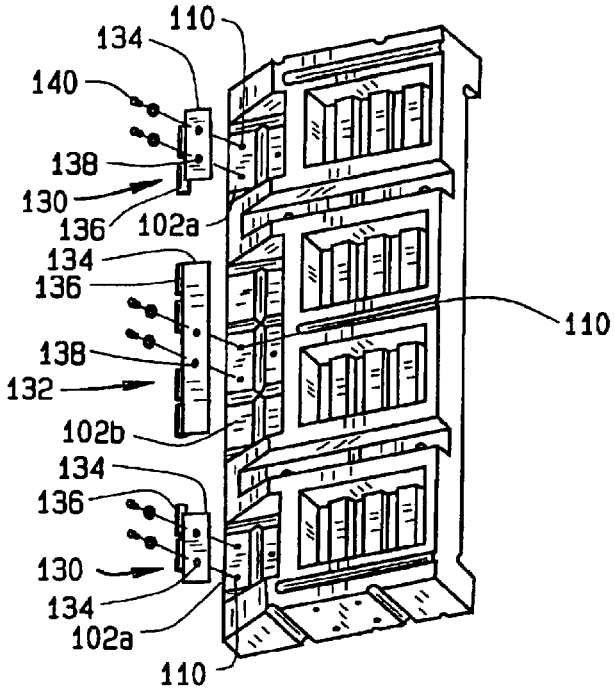
FIG. 14 is an exploded view showing the connection of hinge members to the gangway section.

Turning to FIG. 14, hinges 130 and 132 can be mounted to the attachment surfaces 102*a* and 102*b*, respectively, to enable the gangway section 10 to be mounted to shore abutments, decks, etc. The hinges 130 each include a mounting plate 134 and pin sleeves 136. The hinge mounting plates 134 have a width substantially equal to the width of the respective attachment surface 102*a,b* and holes 138 positioned to be aligned at least with the two end holes 110 on the gangway attachment surface. Screws 140 are used to secure the hinge plates to the attachment surfaces 102*a,b*. As best seen in FIG. 3, the hinges 130 are generally L-shaped and include a leg 142 at the end of the mounting plate 134 to which the hinge pin sleeves 136 are mounted. The hinge leg 142 overlies the end surface of the gangway section 10. Hence, the hinge pin sleeves 136 extend outwardly from the gangway end surface.

Figure 15:
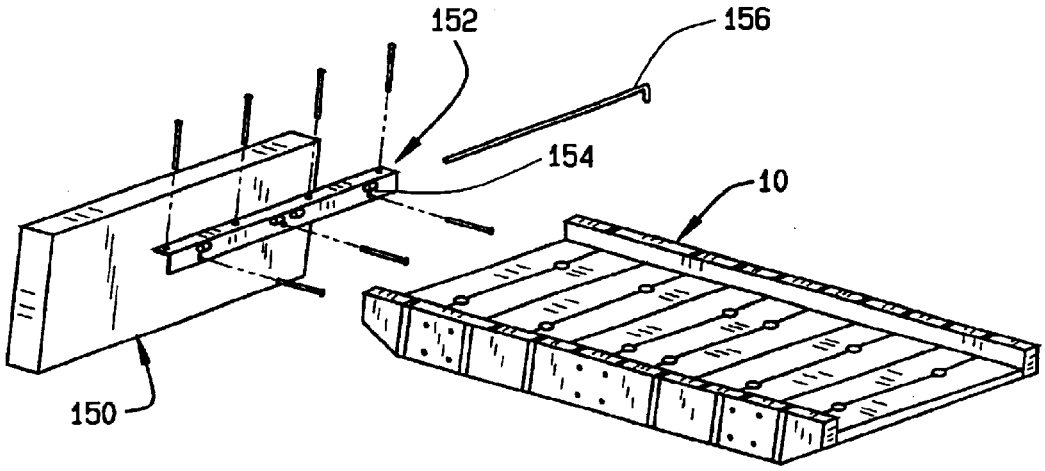
FIG. 15 is an exploded view showing the connection of the gangway section to a shore abutment.

Connection of the gangway section 10 to a shore abutment 150 As seen in FIG. 15, a mating hinge plate 152 is mounted to the shore abutment 150. The hinge plate 152 is shown to be generally a right angle member which overlies a corner of the shore abutment 150 and is connected to the shore abutment by screws, bolts, or other fasteners which extend through both legs of the angle member. Pin sleeves 154 are positioned on the generally vertical leg of the hinge plate 152 and are positioned to be offset from the pin sleeves 136 of the hinge plates 130 mounted to the gangway attachment surface. A hinge pin 156 passes through the pin sleeves of the opposing hinge plates to hingedly connect the gangway section 10 to the shore abutment 150.

Figure 16:
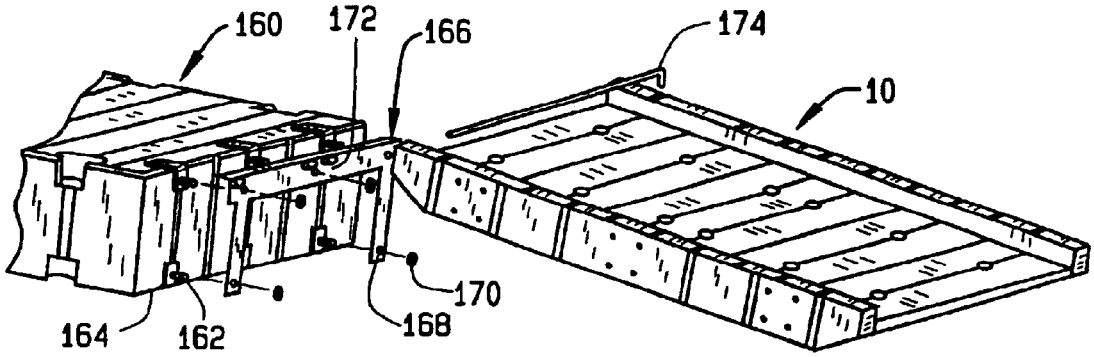
FIG. 16 is an exploded view showing the connection of the gangway section to a dock section.

In FIG. 16, the gangway 10 is shown connected to a floating dock section 160. The dock section 160 is preferably one such as U.S. Pat. No. 5,280,155, which is incorporated herein by reference. The dock section 160 is provided with hardware connectors 162 having threaded shafts 164 extending outwardly therefrom. A hinge plate or bracket 166 is mounted to a side surface of the dock section 160 using the hardware connectors 162. As seen, the bracket 166 is generally U-shaped in configuration, and includes holes 168 in its legs and top cross member. The holes 168 are positioned to be aligned with the connector shafts 164, and the shafts 164 extend through the bracket holes 168 to receive nuts 170 to secure the bracket 166 to the dock section 160. The bracket additionally includes pin sleeves 172 positioned along the cross-member of the bracket 166. The pin sleeves are positioned to be offset from the pin sleeves of the gangway hinge. A hinge pin 174 is passed through the respective pin sleeves to hingedly connect the gangway section 10 to the dock section 160. The bracket 166 is sized and positioned on the dock section 160 such that the upper surface of the gangway and the upper surface of the dock 160 will be substantially co-planar when the gangway is connected to the dock section.

Figure 17:
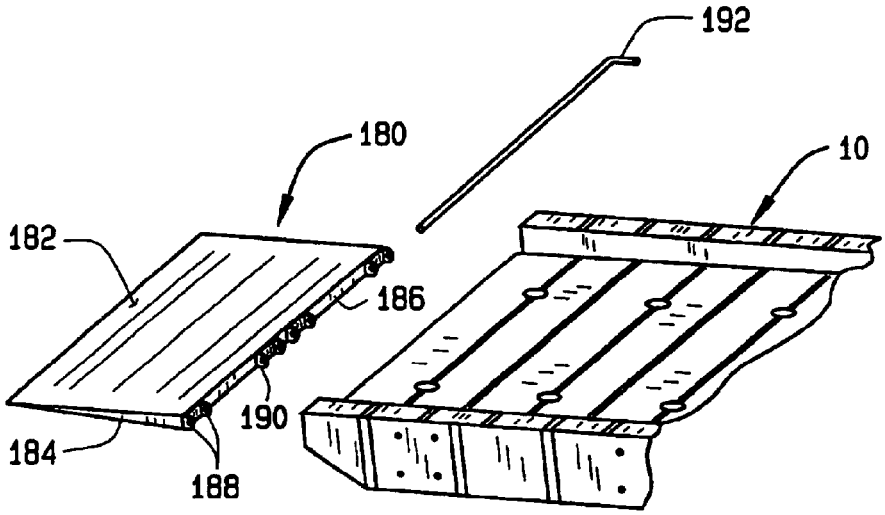
FIG. 17 is an exploded view showing the connection of a ramp or transition plate to the gangway section.

FIG. 17 shows the connection of a ramp or transition plate 180 to the gangway 10. The ramp 180 is generally triangular in side elevation and has a top surface 182, side surfaces 184, and a back surface 186. A plurality of ears 188 extend from the back surface 186 and have openings 190 through which a hinge pin 192 can extend. As can be appreciate, the hinge pin 192 extends through the pin sleeves of the gangway hinges and through the ears of the ramp. Preferable, the ramp ears 188 are arranged in pairs, the ears of each pair being spaced apart a distance slightly greater than the length of the gangway hinge pin sleeves. Hence, the ramp ears sandwich the gangway hinge pin sleeves. Additionally, the number of pairs of ears corresponds to the number of pin sleeves on the gangway hinge.

As can be appreciated, because the connection between the gangway and the shore abutment, ramp, and/or dock is hinged, the gangway can pivot about the hinge pin as the dock, pier, etc. to which the gangway is connected is raised and lowered by water, or simply as the water level in the lake, pond, etc. changes. Additionally, the hinged connection at the opposite ends of the gangway allow for the gangway to move slightly relative to the shore and dock, pier, etc. when someone steps on the gangway.

Figure 18:
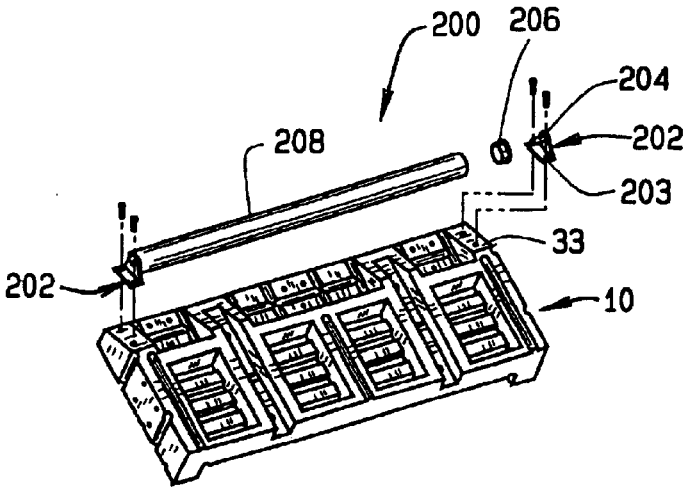
FIG. 18 is an exploded view showing the connection of a roller to the gangway section.

Lastly, FIG. 18 shows a roller assembly 200 which is mounted to the gangway section 10. The roller assembly includes a roller bracket 202 having a base which is connected to the sloped surface 33 of the gangway wall 24. An axle 204 extends inwardly from the bracket 202 and receives a bearing 206. A roller 208 is mounted on the bearings 206.

The roller assembly 200 protects the gangway 10 by allowing it to roll due to vertical movement when the opposite end of the gangway is connected to a floating dock or pier. As can be appreciated, because the roller assembly is mounted to the gangway side walls 24, rather than to the attachment surfaces 102*a,b*, the roller assembly 200 and the ramp 180 can both be mounted to the gangway.

As various changes could be made in the above constructions without departing from the scope of the invention, it is intended that all matter contained in the above description or shown in the accompanying drawings shall be interpreted as illustrative and not in a limiting sense. For example, the inner recesses 56 and 58 could be formed as a single column of recesses, rather than as two columns of recesses. Alternatively, the recesses could be formed in a pattern other than a 4×3 array. The cross-sectional profile of the recess ceiling grooves could be changed—they could all be arched or triangular, for example. Some (or all) of the grooves of the inner recesses 56 and 58 could be formed similarly to the grooves 90*b* to include portions of greater wall thickness. Conversely, all the recess ceiling grooves could be formed like the grooves 90*a*, wherein the groove wall is of a substantially constant thickness across the length of the groove. These examples are merely illustrative.

What is claimed is:

1. A molded gangway section comprising an upper surface, side surfaces, and a lower surface, said surfaces defining a volume; said lower surface comprising a plurality of recesses; said recesses being defined by a side wall extending from said lower surface towards said upper surface and a recess ceiling; said recess ceiling comprising a plurality of grooves in said ceiling which extend toward said gangway upper surface; said recess ceiling grooves are adjacent said upper surface and said recess ceiling grooves contact said upper surface or are spaced slightly from said upper surface.

2. The gangway section of claim 1 wherein said recess ceiling grooves are substantially parallel to each other.

3. The gangway section of claim 2 wherein said recess ceiling grooves include at least one first groove and at least one second groove; said first groove being defined by a surface having a generally constant width and said second groove having a first portion with a surface of a first thickness and a second portion with a surface of a second thickness; said second portion surface being a continuation of said first portion surface.

4. The gangway section of claim 3 wherein said gangway upper surface includes a groove; said upper surface groove and said recess ceiling grooves being generally parallel to each other; said upper surface groove being offset from said recess ceiling second groove and above said recess ceiling first groove.

5. The gangway section of claim 4 wherein said gangway upper surface groove and said recess ceiling first groove are in contact with each other.

6. A molded gangway section comprising an upper surface, side surfaces, and a lower surface, said surfaces defining a volume; said lower surface comprising a plurality of recesses; said recesses being defined by a side wall extending from said lower surface towards said upper surface and a recess ceiling; said recess ceiling comprising a plurality of grooves in said ceiling toward said gangway upper surface;

wherein two or more of said gangway sections are connected together to form a gangway; said gangway sections each comprising at least one elongate channel extending substantially the length of the gangway sections; said channels receiving a reinforcing member which extends substantially across adjacent gangway sections.

7. The gangway section of claim 6 wherein said reinforcing member comprises a truss member sized to span a junction between adjacent gangway sections.

8. A molded gangway section comprising an upper surface, side surfaces, and a lower surface, said surfaces defining a volume; said lower surface comprising a plurality of recesses; said recesses being defined by a side wall extending from said lower surface towards said upper surface and a recess ceiling; said recess ceiling comprising a plurality of grooves in said ceiling toward said gangway upper surface;

wherein two or more of said gangways are connected together to form a gangway of a desired length; said gangway sections each including a connecting portion at at least one end of said gangway sections; said gangway section further including a connecting plate; said connecting plate being sized to span a junction between adjacent gangway sections and being secured to an underside of said gangway section upper surface of each of said gangway sections.

9. The gangway of claim 1 wherein said volume is hollow.

10. The gangway of claim 1 wherein said side surfaces define a wall extending above said upper surface.

11. The gangway of claim 10 including a groove along the junction between said upper surface and at least one of said side walls.

12. A molded gangway comprising:

an upper surface; said upper surface including spaced apart grooves;

side surfaces; and a lower surface; said lower surface comprising a plurality of recesses; said recesses being defined by a side wall extending from said lower surface towards said upper surface and a recess ceiling; said recess ceiling being spaced from said upper surface;

a plurality spaced apart grooves in said recesses; said grooves extending across said recesses and being defined by a groove wall, said groove wall being adjacent a bottom side of said gangway upper surface;

said recess ceiling grooves being generally parallel to said upper surface grooves; at least some of said recess ceiling grooves being adjacent at least some of said upper surface grooves said recess ceiling grooves including at least one first groove and at least one second groove; said wall of said first groove being of a generally constant width and said wall of said second groove having a first portion having a first thickness and a second portion having a second thickness; said gangway upper surface grooves being offset from said recess ceiling second groove and above said recess ceiling first groove.

13. The gangway of claim 12 wherein said recess ceiling grooves contact said upper surface; said recess ceiling first groove contacting said upper surface grooves and said recess ceiling second grooves contacting said upper surface between said gangway upper surface grooves.

14. The gangway of claim 12 wherein said recesses are formed in at least three columns, there being two outer columns and at least one inner column.

15. The gangway of claim 14 wherein each column of recesses includes two or more rows of recesses.

16. The gangway of claim 15 wherein grooves are formed in said bottom surface between said rows of recesses.

17. The gangway of claim 15 including grooves in said gangway bottom surface between said outer columns of recesses and the sides of said gangway.

18. The gangway of claim 14 wherein a trough is formed in the section of said gangway bottom surface which separates said outer and inner columns of recesses.

19. The gangway of claim 14 wherein the recess grooves of said inner column are all identical.

20. The gangway of claim 14 wherein at least one of said grooves of said outer column recess includes a first portion having a wall of a first thickness and a second portion having a wall of a second thickness.

21. The gangway section of claim 12 wherein said gangway includes a connection surface at at least one end thereof and a hinge member mountable to said connection surface, said hinge member including a pin sleeve which, when said hinge member is mounted to said gangway section, extends outwardly from said end of said gangway section.

22. A molded gangway comprising:

an upper surface;

side surfaces; and a lower surface; said lower surface comprising a plurality of recesses: said recesses being defined by a side wall extending from said lower surface towards said upper surface and a recess ceiling; said recess ceiling being spaced from said upper surface;

a plurality spaced apart grooves in said recesses; said grooves extending across said recesses and being defined by a groove wall, said groove wall being adjacent a bottom side of said gangway upper surface;

a connection surface at at least one end thereof and a hinge member mountable to said connection surface, said hinge member including a pin sleeve which, when said hinge member is mounted to said gangway section, extends outwardly from said end of said gangway section;

said gangway including a bracket mountable to a shore abutment, pier, dock, or the like; said bracket including pin sleeves positioned to be aligned with the pin sleeves of said hinge member; said gangway section including a hinge pin which extends through the pin sleeves of said hinge member and said bracket.

23. The gangway section of claim 22 wherein the gangway section includes a roller assembly and/or a ramp.

24. The gangway section of claim 23 wherein said ramp includes a sloped upper surface, a back surface, and ears extending from said back surface; said ears including openings therein which are aligned with said hinge member pin sleeves when said ramp is adjacent said gangway section; said gangway section including a hinge pin which extends through the pin sleeve of said hinge member and said ramp ears to hingedly connect said ramp to said gangway.

25. The gangway section of claim 23 wherein said roller assembly includes opposed mounting members mountable to lower surfaces of the sides of said gangway and a roller extending between said mounting members; whereby said roller is vertically spaced from said connecting surface and said mounting brackets are horizontally spaced from said connecting surface, such that said roller assembly can be mounted to said gangway along with said ramp.

* * * * *